United States Patent [19]

Walker

[11] Patent Number: 4,862,651

[45] Date of Patent: Sep. 5, 1989

[54] DOWNSPOUT SHIELD

[76] Inventor: Robert B. Walker, 34 14th St., Hermosa Beach, Calif. 90254

[21] Appl. No.: 204,354

[22] Filed: Jun. 9, 1988

[51] Int. Cl.[4] ..... E04D 13/08

[52] U.S. Cl. ..... 52/16; 52/12

[58] Field of Search ..... 52/16, 12, 11

[56] References Cited

U.S. PATENT DOCUMENTS

| | | | |
|---|---|---|---|
| 2,373,394 | 4/1945 | Hall | 52/16 |
| 3,060,952 | 10/1962 | Bystrom | 52/16 |
| 4,270,572 | 6/1981 | Jarzynka | 52/16 |
| 4,608,786 | 9/1986 | Beam | 52/16 |
| 4,615,153 | 10/1986 | Carey | 52/16 |
| 4,641,464 | 2/1987 | Andersson et al. | 52/16 |

FOREIGN PATENT DOCUMENTS

| | | | |
|---|---|---|---|
| 1188476 | 6/1985 | Canada | 52/16 |

*Primary Examiner*—David A. Scherbel
*Assistant Examiner*—Michele A. VanPatten

[57] ABSTRACT

Shield means for surrounding or replacing the lower portion of a downspout to prevent damage to the downspout structure.

9 Claims, 1 Drawing Sheet

DOWNSPOUT SHIELD

BACKGROUND

1. Field of Invention

This invention relates to downspouts and is particularly directed to shield means for protecting downspouts against damage by automobiles, vandals and the like.

2. Prior Art

Downspouts have long been used to guide water from gutters on the eaves of buildings downward, in a manner to prevent splattering to suitable drainage means on the ground. Since, in general, very little strain is placed on such downspouts, it is common practice to fabricate the downspouts from very light and inexpensive material, such as mild steel, aluminum or plastic. Unfortunately, when the downspouts are located adjacent an automobile parking area, as in the parking shed of an apartment complex, drivers attempting to park their automobiles therein frequently miss the parking area and ram the post or wall to which the downspout is attached. Furthermore, vandals often dent or smash the downspouts for whatever purpose such vandalism is ever performed. When these events occur, the downspout is usually dented or crushed, which interferes with the flow through the downspout. Moreover, since leaves, twigs and other debris are often carried by the flow through the downspout, such denting or crushing frequently will cause clogging of the downspout, which may result in overflow of the roof gutter, rotting of any wooden structure adjacent the roof gutter and other damage. Consequently, it becomes neccessary to replace the downspout. Unfortunately, such damage to downspouts is quite frequent and, therefore, often becomes a major maintenance expense.

BRIEF SUMMARY AND OBJECTS OF INVENTION

The disadvantages of the prior art are overcome with the present invention and shield means is provided for protecting the downspout by surrounding or replacing the lower portion of a downspout with a shield member comprising a tubular member formed of damage resistant material, such as steel tubing of ¼ inch wall thickness. The protective shield can be provided to substantially any desired height to assure the integrety of the downspout structure throughout the danger area.

A search in the United States Patent Office has located the following references:

| U.S. Pat. No. | INVENTOR | ISSUED |
|---|---|---|
| 2,373,394 | H. E. Hall | Apr. 10, 1945 |
| 4,270,572 | C. J. Jarzyuka | Jun. 2, 1981 |
| 4,608,786 | T. D. Beam | Sep. 2, 1986 |
| 4,641,464 | K. G. Anderson et al | Feb. 10, 1987 |

Each of the reference patents discloses a downspout construction. However, none of the reference patents suggests any means for preventing damage or vandalism to the downspout. Thus, none of the prior art devices has been entirely satisfactory.

Accordingly, it is an object of the present invention to provide improved downspouts.

Another object of the present invention is to provide means for protecting a downspout against damage by automobiles, vandals and the like.

A specific object of the present is to provide shield means for surrounding or replacing the lower portion of a downspout to prevent damage to the downspout structure.

Another specific object of the present invention is to provide means for protecting a downspout by surrounding or replacing the lower portion of a downspout with a shield member comprising a tubular member formed of damage resistant material, such as steel tubing of ¼ inch wall thickness.

These and other objuects and features of the present invention will be apparent from the following detailed description, taken with reference to the figures of the accompanying drawing.

DETAILED DESCRIPTION OF THE INVENTION

Figure 1:
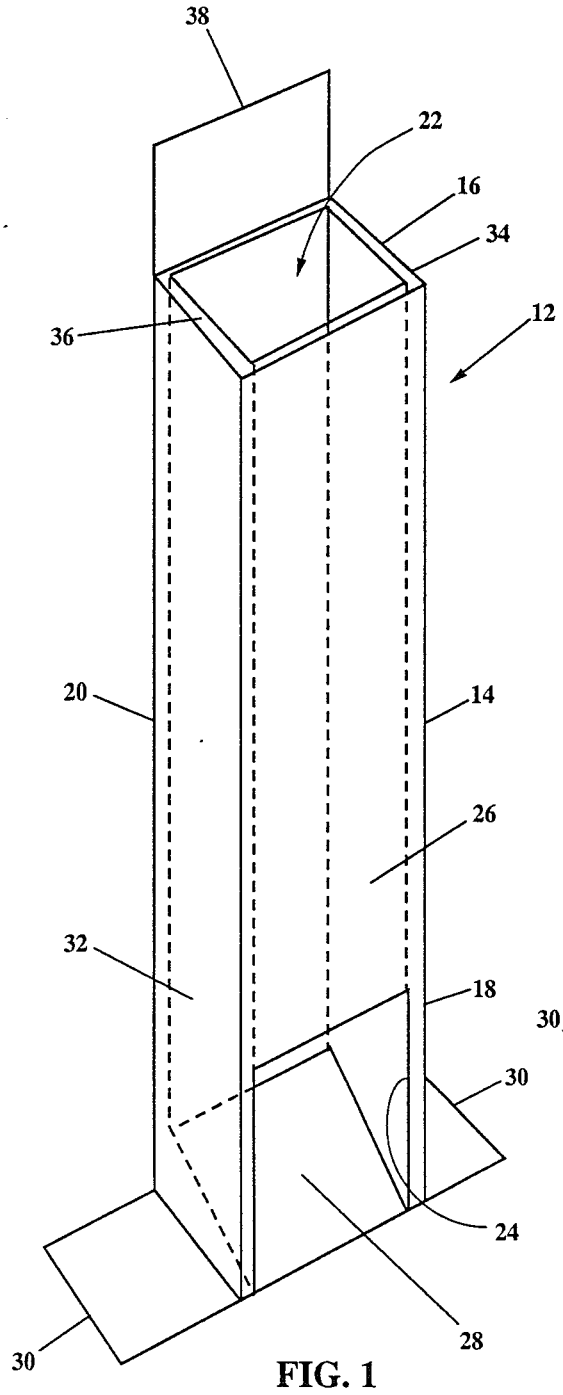
FIG. 1 is an isometric view of a downspout shield embodying the present invention.

In that form of the present invention chosen for purposes of illustration in FIG. 1, a downspout shield, indicated generally at 12, is shown comprising an elongated, generally rectangular, tubular member 14 having an upper end 16, a lower end 18 and an intermediate portion 20 with a central opening 22 extending axially therethrough which is dimensioned to slideably receive the lower end of a conventional downspout. The downspout shield 12 is formed of damage resistant material, such as ¼ inch wall steel, and the intermediate portion 20 is of sufficient length to extend from the ground upward to a point above that where damage to the downspout is likely to occur. Thus, where the most probable source of damage to the downspout is collision by automobiles, the intermediate portion 20 should have a length of approximately 3 feet. On the other hand, at loading docks and the like, where damage is likely from large trucks having higher bumpers and beds, the length of the intermediate portion 20 could be extended to 6 feet or made as long as needed to provide the desired downspout protection. Adjacent the lower end 18 of the shield 12, an opening 24 is formed in the front wall 26 and an inclined floor member 28 is positioned therein to close the bottom of the central opening 22 and to direct water and debris flowing from the downspout to be discharged out of the opening 24.

Horizontal flanges 30 are provided on the bottom ends of the side walls 32 and 34 of the shield 12 to permit the lower end 14 of the shield 12 to be secured to the ground or a suitable supporting member by nails, bolts or other suitable means. At the upper end 15 of the shield 12, the rear wall 36 is provided with a vertically extending flange 38 to permit securing the upper end 16 of the shield 12 to a suitable wall, post or other appropriate supporting member.

In use, the lower end of a conventional downspout is slid into the central opening 22 of the shield 12 at the upper end 16 thereof and the shield 12 may surround or replace the lower portion of the downspout. In this way, water and debris flowing from the downspout can pass through the central opening 22 of the shield 12 and will be discharged out of the opening 24 to the usual drainage. However, due to the strong construction of the shield 12, if an automobile bumps into the shield 12, the shield 12 will resist denting or crushing by the automobile and will protect the downspout from damage. Thus, flow of the drainage through the downspout will not be interrupted and damage to the roof will be avoided.

Figure 2:
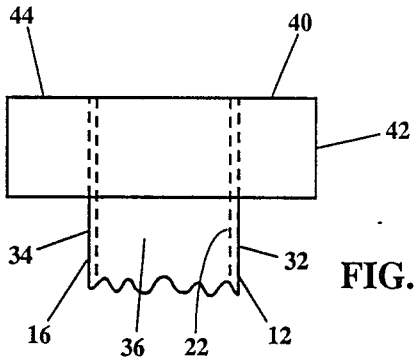
FIG. 2 is a rear view of the upper end of an alternative form of the downspout shield of FIG. 1.
Figure 3:
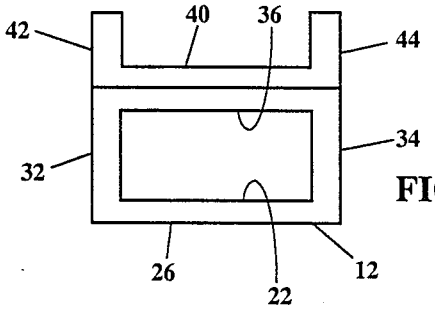
FIG. 3 is a top view of a further alternative form of the downspout shield of FIG. 1.
Figure 4:
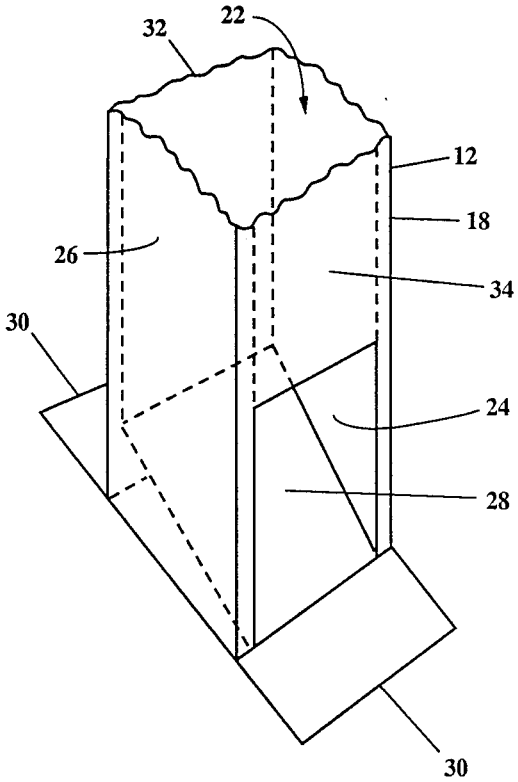
FIG. 4 is a view of the lower portion of another alternative form of the downspout shield of FIG. 1.

FIG. 2 shows an alternative form of the downspout shield of FIG. 1 wherein the vertical securing flange 38 of FIG. 1 is omitted and is replaced by a horizontal strip 40 which is secured to the upper end 16 of the rear wall 36 of the shield 12 by suitable means, such as welding soldering, rivets or bolts, and projects laterally beyond the side walls 32 and 34 of the shield 12 to provide lateral securing flanges 42 and 44 which may be secured to a supporting wall, post or the like by suitable means, such as nails, screws, bolts, etc. There the supporting member is narrower than the rear wall 36 of the shield 12, the securing flanges 42 and 44 may be bent rearwardly, as seen in FIG. 3, and may be secured to ther sides of the supporting member. Moreover, where necessary or desirable, additional securing strips, such as strip 40, may be provided at appropriate locations along the intermediate portion 20 of the shield 20 to permit additional securing. In some instances, it may be undesirable to have the drainage water discharged from the front wall 26 of the shield 12. In such instances, an alternative form of the shield 12 may be provided, as seen in FIG. 4, wherein the discharge opening 24 is formed in one of the side walls, in this instance, side wall 34, and the inclined bottom plate 28 is mounted to discharge the drainage material laterally.

Obviously, if necessary or desireable, the bottom securing flanges 30 could be replaced by a strip, such as the strip 40 of FIG. 2 and the flanges could be bent rearwardly, as seen in FIG. 3. Furthermore, although the downspout shield has been shown in the accompanying drawings as being rectangular in cross section, it will be apparent that some downspouts are circular in cross section and, to protect these circular downspouts, the shield of the present invention could clearly be formed of circular tubing of ¼ inch steel. In addition, numerous other variations and modifications could be made without departing from the spirit of the present invention. Therefore, it should be clearly understood that the forms of the present invention described above and shown in the accompanying drawings are illustrative only and are not intended to limit the scope of the present invention.

I claim:

1. A downspout shield comprising:

An elongated tubular member formed of damage resistant material dimensioned to slideably receive the lower end of a downspout having a plurality of securing flanges projecting from the exterior of said tubular member and having a discharge opening formed in at least one of the walls of said tubular member adjacent the lower end thereof and having an inclined floor member located within said tubular member adjacent said opening to direct material flowing through said shield to pass out said opening.

2. The downspout shield of claim 1 wherein:

said damage resistant material is ¼ inch wall steel.

3. The downspout shield of claim 1 wherein:

said shield is rectangular is cross section.

4. The downspout shield of claim 1 wherein:

said securing flanges are located adjacent the upper and lower ends of said tubular member.

5. The downspout shield of claim 1 wherein:

said securing flanges are integral with the adjacent wall of said tubular member and project outwardly therefrom.

6. The downspout shield of claim 1 wherein:

said securing flanges are portions of a horizontal strip secured to the rear wall of said tubular member and having portions projecting laterally beyond said tubular member to define said securing flanges.

7. The downspout shield of claim 1 wherein said discharge opening is formed in the front wall of said tubular member and said floor member has its highest edge secured inside the rear wall of said tubular member and inclines downwardly and forwardly and has the front edge of said floor member secured adjacent the bottom of the front wall of said tubular member.

8. The downspout shield of claim 1 wherein:

said discharge opening is formed in one side wall of said tubular member and said floor member has its highest edge secured inside the opposite side wall of said tubular member and inclines downward and laterally and has its lowest edge secured adjacent the bottom of said one side wall of said tubular member.

9. The downspout shield of claim 4 wherein:

the securing flanges located adjacent the lower end of said tubular member project horizontally outward from said lower end to permit securing said lower end of said tubular member to the ground.

* * * * *